US005352053A

United States Patent [19]

Reitze

[11] Patent Number: 5,352,053

[45] Date of Patent: Oct. 4, 1994

[54] WRITING INSTRUMENT AND CAP

[76] Inventor: Frederick Reitze, 2659 W. Arthur, Chicago, Ill. 60645

[21] Appl. No.: 87,257

[22] Filed: Jul. 8, 1993

[51] Int. Cl.[5] ..... B43K 9/00

[52] U.S. Cl. ..... 401/202; 401/98; 401/213; 401/243

[58] Field of Search ..... 401/98, 202, 213, 59, 401/60, 243

[56] References Cited

U.S. PATENT DOCUMENTS 1,615,506 1/1927 Felt ..... 401/202 X

FOREIGN PATENT DOCUMENTS 2221872 2/1990 United Kingdom ..... 401/202

8200614 3/1982 World Int. Prop. O. ..... 401/202

*Primary Examiner*—Steven A. Bratlie

*Attorney, Agent, or Firm*—Donald L. Barbeau

[57] ABSTRACT

Disclosed is an improved writing instrument having a slidably and pivotably disposed cap for covering the writing tip. The improved cap retaining feature improves the manageability of the instrument such that the cap can be removed and lodged into its open position by a continuous motion of the hand which is holding the instrument.

9 Claims, 2 Drawing Sheets

28
26
62

29
28
22
56
52
64
54
62

47
34
44
43
42
46

36
56
54

29
28
52

36
30
34
43
44
47

28
22
29
9
20
24
9

WRITING INSTRUMENT AND CAP

BACKGROUND OF THE INVENTION

Marking pens have become a commonly used writing implement because of their versatility and unique marking characteristics. They are not only used by artists and students, they are commonly used in many businesses whenever a bold or highlighted entry is necessary. Improvements in the ink, writing tips, and manufacture have progressed steadily to produce low cost, high quality writing implements. A principal advantage of marking pens is their ability to employ porous felt tips having a variety of different colored inks.

Nevertheless, conventional marking pens have several inherent deficiencies. One of these deficiencies is the requirement that the pen's inked tip, generally porous felt impregnated with ink, must be kept covered when not in use. Because the inked porous tip of many marking pens has a tendency to dry out when left exposed to the atmosphere, these pens have a separate cap for covering the felt tip when not being used for writing. Quite often, users of the pen have a tendency to remove the cap carelessly and set it aside. When it is time to replace the cap, the user spends several irritating seconds searching for the cap. This is particularly annoying when the user is busy and concentrating on performing his or her duties.

Thus, the ink-impregnated porous tip of conventional marking pens has created a dilemma not encountered by other types of writing implements such as pencils, colored wax, and the like. Heretofore, a convenient method of keeping track of the cap used to cover this felt tip portion of marking pens has not been available.

SUMMARY OF THE INVENTION

In accordance with the present invention, disclosed is a writing instrument comprising an elongated cylindrical body having a first end, a second end, and a passage extending from said first end to said second end; a writing means disposed within said passage and extending outwardly from the first end; and a cap means having a body for covering the first end of said cylindrical body, an arm extending from said first side of said body portion, and an indent disposed on an opposite side of said body portion to facilitate removal of the cap means from said cylindrical body, and at least one ridge disposed on said first side; said arm having a first and second projection extending outwardly from the terminal end of said arm; said cap being pivotably and slidably mounted within channels; wherein said cylindrical body has a continuous groove extending from the first end of said body to the second end of said body; said grooves having channel portions disposed at said first end and extending longitudinally toward said second end adapted to receive said outwardly extending projections.

DETAILED DESCRIPTION OF THE PREFERRED EMBODIMENT OF THE PRESENT INVENTION

Figure 1:
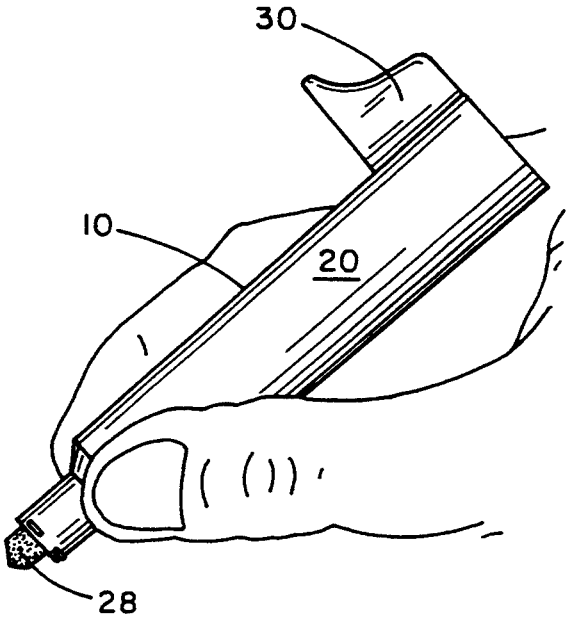
FIG. 1 is a perspective view of the improved marking pen in accordance with present invention.
Figure 3:
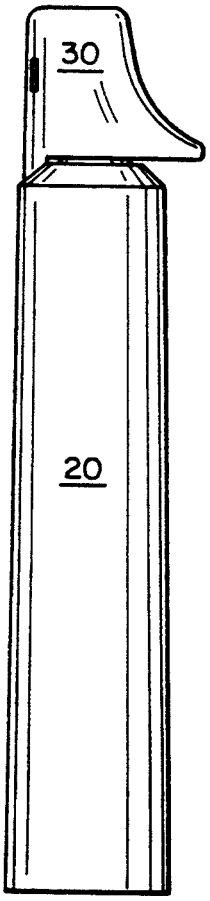
FIG. 3 is a side elevational view of the marking pen having its cap in place over the felt tip in accordance with the present invention.

In accordance with a preferred embodiment of the present invention, disclosed is marking pen 10 having a substantially cylindrical elongated body portion 20. The cylindrical body portion can be made of any durable material and is preferably made of plastic material. The cylindrical body 20 has a first end 22, a second end 24, and a passageway 26 extending longitudinally from the first end 22 to the second end 24. A writing element 28, preferably one having a tendency to dry out when exposed to the atmosphere such as a porous ink impregnated felt strip, is generally disposed within this passageway 26 and extends outwardly from the first end 22 of the body 20. The tip of the writing element is generally beveled as clearly shown at 29 in FIGS. 2, 5, 6 and 9 to facilitate writing.

Disposed on the first end of the cylindrical body 20 is a cap member 30 for making a closure over the writing element 28 when not in use. The cap has a body portion 32 which is generally complementary in shape to the first end 22 of the cylindrical body 20 of the pen. The cap member has a closed end 31 and an open end 33 for sliding over the first end 22 of the cylindrical body 20 when it is desired to cover the tip of the writing element 28.

Figure 2:
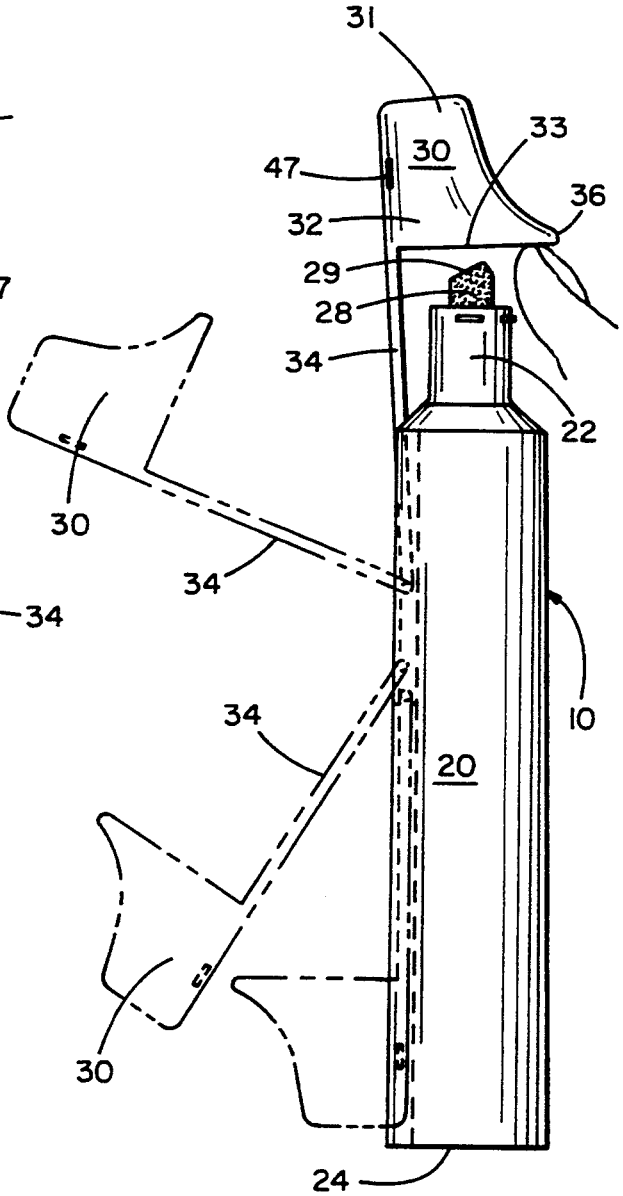
FIG. 2 is a side elevational view of the improved marking pen having its cap removed in accordance with present invention.

Extending outwardly from the perimeter of the open end 33 of the cap member 30 is an elongated arm 34 which pivotably joins the cap member 30 with the elongated cylindrical body 20 of the pen. The arm 34 extends a distance from the open end 33 sufficient to permit the cap member 30 to be slidably removed from the end and pivoted downwardly to engage the cap receiving area adjacent the second end 24 of the cylindrical body 20 as shown in FIG. 2.

Figure 4:
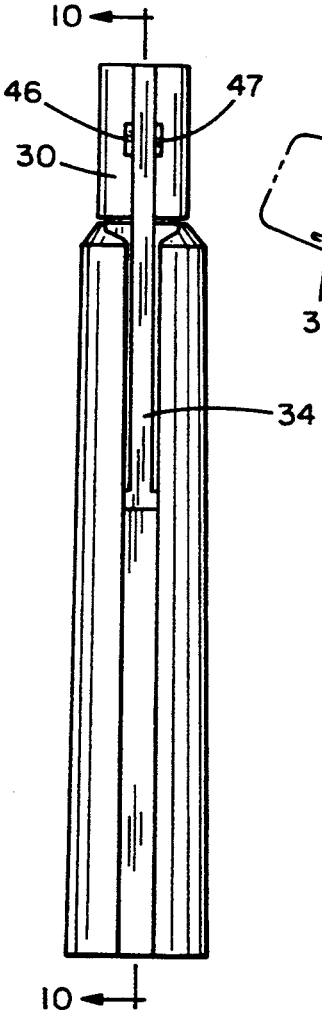
FIG. 4 is a side elevational view of the marking pen in accordance with the present invention showing the groove and cap-arm relationship.
Figures 5, 6, 7, 8, 9, 10, 11:
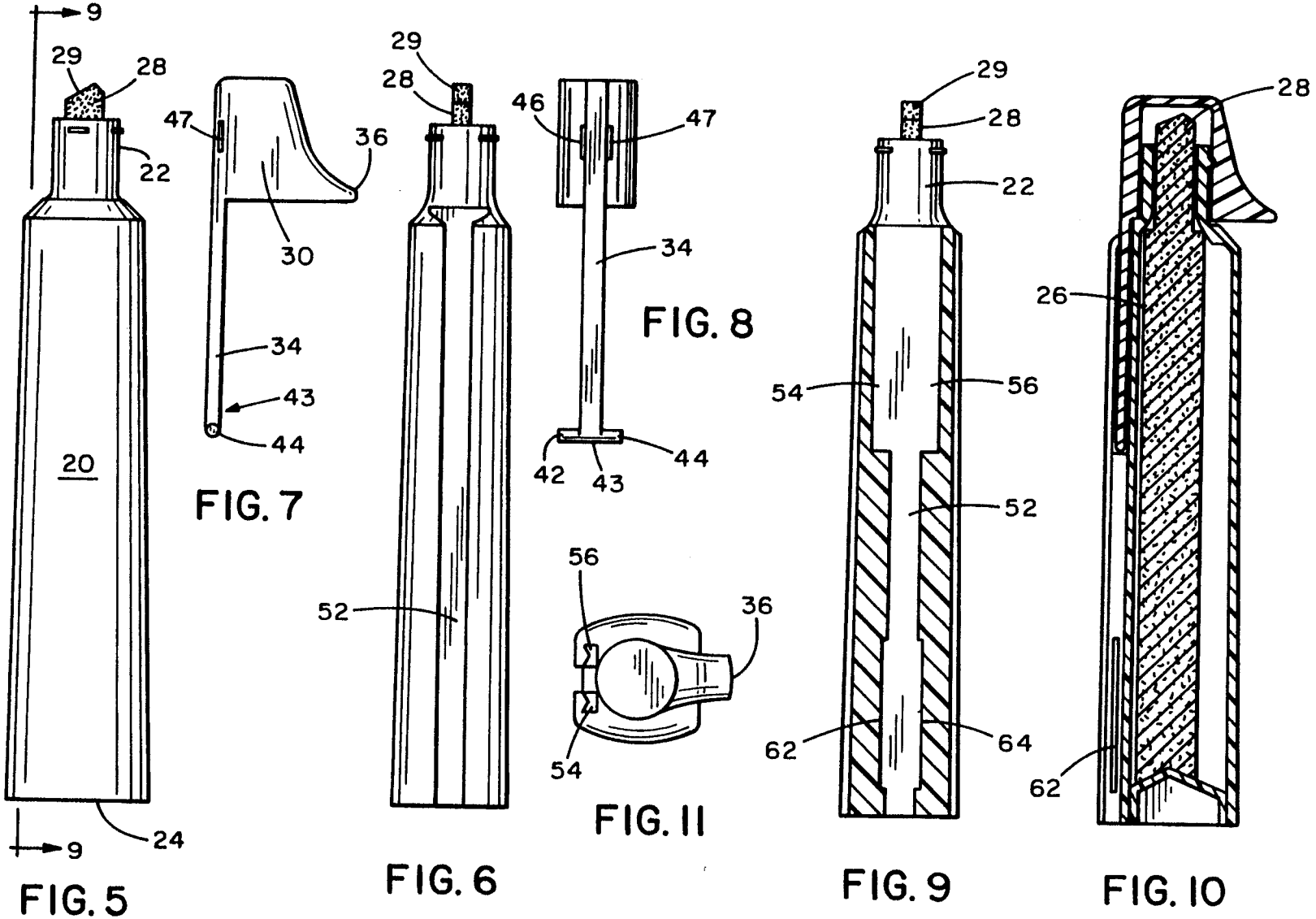
FIG. 5 shows the pen in accordance with the present invention with the cap means separated from the cylindrical body.
FIG. 6 is a side view of the pen shown in FIG. 5.
FIG. 7 is a side elevational view of the cap used to cover the felt tip in accordance with the present invention.
FIG. 8 is a side elevational view of the cap shown in FIG. 7 from a different side.
FIG. 9 is a cross sectional view of the pen in accordance with the present invention along line 9—9 of FIG. 5.
FIG. 10 is a cross sectional view of the pen in accordance with the present invention along line 10—10 of FIG. 4.
FIG. 11 is a top plan view of the pen in accordance with the present invention.

The cap member 30 further includes a means for removing the cap from the pen body 20 with a person's finger. This cap removing means is preferably a projection 36 designed to accommodate a finger as shown in FIG. 2. It is understood that the projection 36 shown here is merely illustrative of the various configurations sufficient to facilitate removal of the cap from the pen while holding the pen in one's hand. Opposite the cap removing means is at least one cap retaining means for retaining the cap in an open position after removal from the writing element. Preferably the cap retaining means are two ridges 46 and 47 which are adapted to engage grooves 62 and 64 disposed on the walls of channel 52 on the lower end of the cylindrical body 20 as shown in FIGS. 2, 4 and 9.

The arm 34 extending from the cap 30 has a first and second projection 42 and 44 extending outwardly and in opposite directions from the terminal end 43 of the arm. These projections 42 and 44 are adapted to engage channels in the cylindrical body 20 and pivotably move the cap from a closed position to an open position as discussed in detail below.

The cylindrical body has a continuous groove 52 extending longitudinally from the first end 22 of the body to a position at or adjacent the second end 24 of the body.

Disposed adjacent the sides of the groove 52 is a pair of channels 54 and 56 which are adapted to engage projections 42 and 44 at the terminal end 43 of the cap arm 34. The length of the channels 54 and 56 can vary, and will be long enough to accommodate the cap arm as it is pivotably and slidably positioned between an open and closed position.

In operation, the cap can be removed from the end of the pen by pressing on the projection portion with one's finger. The cap is displaced upwardly from its seated position on the end of the cylindrical body until it clears the tip of the writing element. The cap is then pivoted downwardly along the side of the cylindrical body until it reaches the cap receiving area where is it secured in its open position. When it is desired to return the cap to its closed position, the cap is pivoted upwardly and slid along the groove until it can cover the writing element again.

Although the present invention has been described in detail and with specific reference to its preferred embodiment, it will be understood by those skilled in the art that various modifications and changes can be made thereto without departing from the spirit and scope of the invention.

I claim:

1. A writing instrument comprising:

an elongated cylindrical body having a first end, a second end, and a passage extending from said first end to said second end;

a writing means disposed within said passage and extending outwardly from the first end;

a cap means having a body for covering the first end of said cylindrical body, an arm extending from a first side of said body, a projection disposed on the opposite side of said body to facilitate removal of the cap means from said cylindrical body, and a cap retaining means disposed on said first side for retaining the cap means in an open position;

said cap means further having a pivot means for pivotably and slidably positioning the cap arm along the cylindrical body;

wherein said cylindrical body has a continuous groove extending from the first end of said body to the second end of said body; said groove having channel portions disposed at said first end and extending longitudinally toward said second end adapted to receive said pivot means; and a cap receiving area disposed adjacent the second end of the elongated cylindrical body, wherein said cap receiving area is adapted to engage said cap retaining means.

2. The writing instrument of claim 1 wherein the cap retaining means is at least one ridge disposed on the side of the cap means.

3. The writing instrument of claim 2 wherein the cap receiving area is a cavity in the side of the elongated cylindrical body.

4. The writing instrument of claim 1 wherein the writing means is an ink impregnated felt material.

5. The writing instrument of claim 4 wherein the cylindrical body and cap means are made of plastic material.

6. The writing instrument of claim 5 wherein the cylindrical body includes a clip means.

7. The writing instrument of claim 3 wherein the writing instrument is a felt tipped pen having an ink impregnated felt material projecting outwardly from said passage and said outwardly projecting felt material is beveled at its distal end.

8. The writing instrument of claim 3 wherein the continuous groove is open at the first end of said elongated cylindrical body.

9. The writing instrument of claim 2 wherein the cap retaining means is adapted to engage the continuous groove adjacent the second end of said elongated cylindrical body.

* * * * *